US006447345B2

(12) United States Patent
Sato et al.

(10) Patent No.: US 6,447,345 B2
(45) Date of Patent: Sep. 10, 2002

(54) RECEPTACLE TERMINAL

(75) Inventors: Naotoshi Sato; Kimihiro Abe, both of Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/757,665

(22) Filed: Jan. 11, 2001

(30) Foreign Application Priority Data

Jan. 24, 2000 (JP) ..... 2000-014423

(51) Int. Cl.[7] ..... H01R 11/22
(52) U.S. Cl. ..... 439/852; 439/842; 439/843
(58) Field of Search ..... 439/852, 842, 439/843

(56) References Cited

U.S. PATENT DOCUMENTS 5,702,272 A * 12/1997 Machida ..... 439/842

FOREIGN PATENT DOCUMENTS

JP 61-180469 11/1986

* cited by examiner

*Primary Examiner*—P. Austin Bradley
*Assistant Examiner*—Alexander Gilman
(74) *Attorney, Agent, or Firm*—Armstrong, Westerman & Hattori, LLP

(57) ABSTRACT

The receptacle terminal has an electrical wire connection portion electrically connected to an electrical wire and an electrical connection portion receiving an opposing terminal pin. The electrical connection portion has a pair of walls accommodating a resilient piece. The resilient piece urges the pin against one of the pair of walls to pinch the pin therebetween. The receptacle terminal is constituted by a blank having parts corresponding to the base wall, the crimping piece, the pair of walls, and the resilient piece. The resilient piece has a joining piece and an extended strip joined to the joining piece. The extended strip of the blank extends along an insertion direction of the pin. The joining piece projects from a longitudinal edge of the one of the pair of walls.

2 Claims, 2 Drawing Sheets

RECEPTACLE TERMINAL

BACKGROUND OF THE INVENTION

1. Field of the Invention

The present invention relates to a receptacle terminal used for electrically connecting an electrical wire to an electrical element such as a busbar, a relay, or a fuse.

2. Related Art

FIG. 5 shows a terminal 101 disclosed in Japan Utility Model Application laid-open 61-180469. The terminal 101 is used for electrically connecting an electrical wire to an electrical element such as a busbar, a relay, and a fuse. The terminal 101 is obtained by bending a sheet of a blank 120 made of an electrical conductive material (FIG. 6). The terminal 101 has an electrical wire connection portion 104 and an electrical connection portion 105.

The electrical wire connection portion 104 has a bottom wall 110*a* and a plurality of crimping pieces 111 each contiguous to a periphery of the bottom wall 110*a*. The electrical wire connection portion 104 is electrically connected to an electrical wire. That is, a stripped core end (not shown) of the electrical wire is disposed on the bottom wall 110*a*, and the stripped core end is secured on the bottom wall 110*a* by bending the crimping pieces 111 to crimp the core end.

The electrical connection portion 105 has a bottom wall 110*b*, a top wall 112 opposing to the bottom wall 110*b*, a side wall 113 joining the bottom wall 110*b* to the top wall 112, and a resilient piece 115. The electrical connection portion 105 is a square barrel. The bottom wall 110*b* of the electrical connection portion 105 unitarily aligns with the bottom wall 110*a* of the electrical wire connection portion 104.

The resilient piece 115 is a thin plate strip. The resilient piece 115 has a part extending along the longitudinal direction of the electrical wire disposed on the bottom wall 110*a*. An end of the resilient piece 115 is contiguous to the top wall 112 at a side of the electrical wire connection portion 104.

The other end of the resilient piece 115 is positioned at a longitudinal middle portion of the bottom wall 110*b*, since the resilient piece 115 is turned back from the one end. The folded part of the resilient piece 115 lies over the bottom wall 110*b* longitudinally along the bottom wall 110*b*.

The resilient piece 115 is a cantilever having one end joined to the top wall 112. The resilient piece 115 is resiliently deflectable such that a free end portion of the resilient piece 115 can move toward and apart from the top wall 112.

The resilient piece 115 has a resilient press-contact portion 116 positioned in the other end side of the resilient piece 115. The resilient press-contact portion 116 is defined in a convex shape projecting toward the top wall 112 at a longitudinal middle portion of the turned-back resilient piece 115. The resilient press-contact portion 116 has a blunt peak.

In the thus configured terminal 101, a pin 102 of an opposing terminal such as a busbar tab illustrated by a chain line P of FIG. 5 is inserted between the side walls 113 and between the bottom wall 110*b* and the top wall 112. The inserted pin 102 contacts the resilient press-contact portion 116 of the resilient piece 115. The insertion of the pin 102 pushes the resilient press-contact portion 116 to move it away from the top wall 112.

The resilient piece 115 urges the pin 102 toward the top wall 112. The resilient piece 115 and the top wall 112 pinches the pin 102 therebetween. Thus, the terminal 101 electrically connects the electrical wire disposed in the electrical wire connection portion 104 to the pin 102.

The blank 120 illustrated in FIG. 6 is obtained by striking out an electrically conductive metal sheet. The blank 120 is substantially rectangular. The blank 120 has a bottom wall part 121 positioned at a lateral central portion thereof, a pair of side wall parts 122, a top wall part 123, a plurality of crimping piece parts 124, and a resilient piece part 126.

The bottom wall part 121, the pair of side wall parts 122, the top wall part 123, the plurality of crimping piece parts 124, and resilient piece part 126 are bent at fold lines shown by chain lines Q of the blank 120. Thereby, the terminal 101 is defined to have the bottom walls 110*a*, 110*b*, the side wall 113, the top wall 112, the crimping piece 111, and the resilient piece 115.

The bottom wall part 121 is a bar extending in a longitudinal direction of the blank 120. Each side wall part 122 is contiguous to a lateral edge of the bottom wall part 121. The side wall part 122 also extends longitudinally. The top wall part 123 is contiguous to an edge of one of the side wall parts 122. The top wall part 123 also extends longitudinally.

Each crimping piece part 124 is contiguous to an edge of the bottom wall part 121. The crimping piece part 124 extends outward from an edge of the bottom wall part 121. The resilient piece part 126 extends longitudinally toward one of the crimping piece parts 124 and has one end contiguous with an end 123*a* of the top wall part 123.

The resilient piece part 126 is positioned in an outward side to longitudinally align with the top wall part 123. The thus configured blank 120 is bent along the fold lines Q, and the resilient piece part 126 is bent such that its tip is positioned near in an edge 122*a* of the side wall part 122 to obtain the terminal 101.

The resilient piece part 126 of the blank 120 is positioned to align with the top wall part 123, and the resilient piece part 126 extends from the top wall part 123 toward another edge 120*a* of the blank 120. Thus, the resilient piece part 126 is positioned close to the crimping piece part 124, so that the crimping piece part 124 tends to have a smaller length along the bottom wall part 121.

Thus, the terminal 101 limits an electrical wire connected to the electrical wire connection portion 104 in thickness. That is, the terminal 101 is not satisfactory for receiving an electrical wire having a comparatively larger thickness.

Moreover, since the resilient piece part 126 is positioned close to the crimping piece part 124, the resilient piece part 126 also tends to have a smaller length. Hence, the resilient piece 115 defined by bending the resilient piece part 126 tends to exert a smaller resilient force on the pin 102 against the top wall 112. Thereby, the pin 102 which has been received between the resilient piece 115 and the top wall 112 might undesirably fall out from them.

In view of the above-mentioned disadvantages, an object of the present invention is to provide a receptacle terminal which can receives an electrical wire having a comparatively larger thickness. The receptacle terminal prevents an unintentional disengagement of a mated terminal pin from the receptacle terminal.

SUMMARY OF THE INVENTION

For achieving the object, a receptacle terminal according to the present invention includes: an electrical wire connection portion electrically connected to an electrical wire and an electrical connection portion receiving an opposing terminal pin. The electrical wire connection portion has a base wall retaining the electrical wire and a plurality of crimping piece contiguous to the base wall for crimping the electrical wire. The electrical connection portion has a pair of walls receiving the pin and a resilient piece, the resilient piece urging the pin against one of the pair of walls to pinch the pin therebetween. The receptacle terminal is defined by bending a blank having parts corresponding to the base wall, the crimping piece, the pair of walls, and the resilient piece. The resilient piece has a joining piece and an extended strip joined to the joining piece. The extended strip extends in an insertion direction of the pin, and the joining piece projects from a longitudinal edge of the one of the pair of walls.

Preferably, the joining piece is contiguous to the one of the pair of walls at a side of the crimping piece, and the blank has the extended strip extending parallel to an insertion direction of the pin toward the crimping pieces.

Preferably, the joining piece of the resilient piece is bent from the edge of the one of pair of walls, and the blank has an opening receiving a folded part of the joining piece.

As described above, the blank of the receptacle terminal has the resilient piece part consisting of the joining piece and the extended strip. The joining piece outwardly extends from the longitudinal edge of the one of the pair of walls. The extended strip is contiguous to the joining piece. Thus, in the blank, the extended strip is in no interference relationship with the crimping piece part. Thus, the crimping pieces and the extended strip (the resilient piece) each have a desired size.

Since the folded part of the joining piece is received in the receiving opening when the resilient piece is formed, the extended strip may have a width substantially equal to the width of the base wall or of the one of pair of walls.

DETAILED DESCRIPTION OF THE PREFERRED EMBODIMENT

Figure 1:
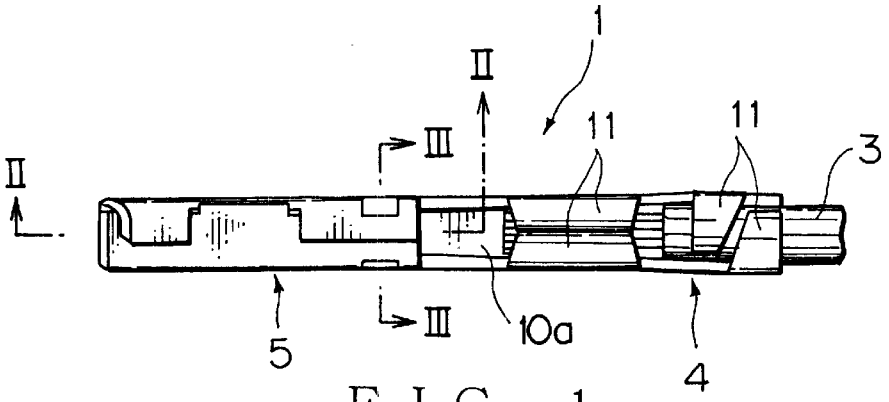
FIG. 1 is a plan view showing a receptacle terminal of an embodiment according to the present invention.
Figure 2:
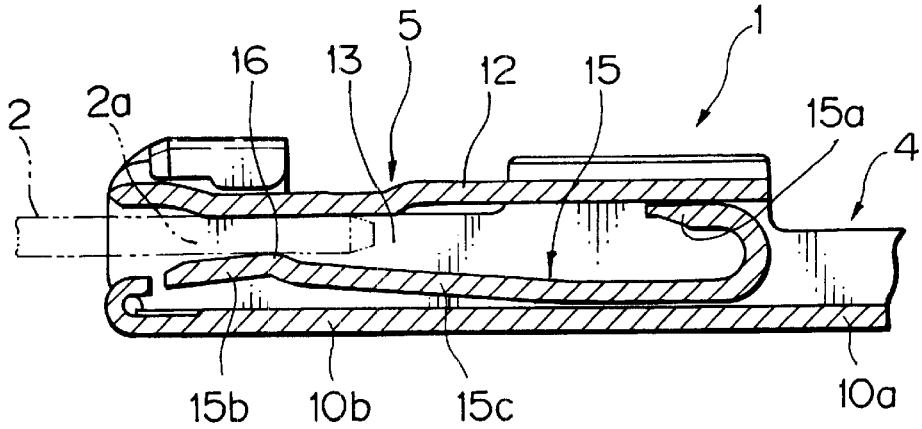
FIG. 2 is a sectional view along line II—II of FIG. 1.
Figure 3:
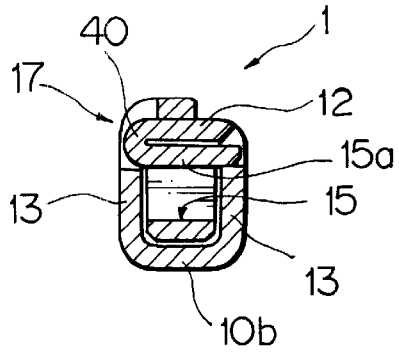
FIG. 3 is a sectional view along line III—III of FIG. 1.
Figure 5:
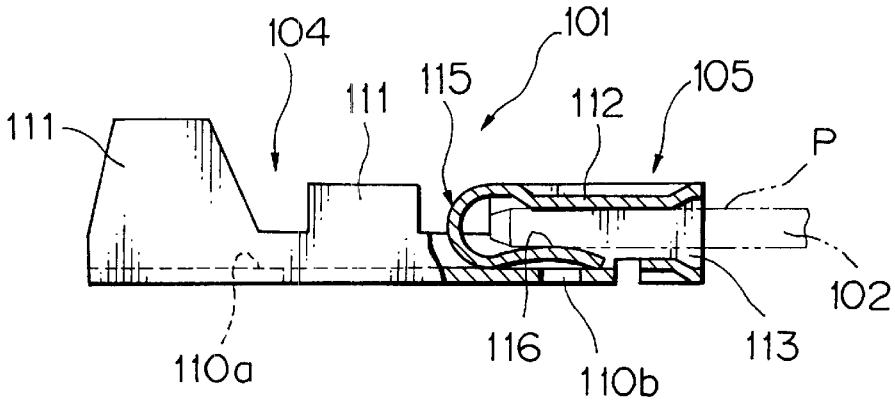
PRIOR ART F I G. 5
FIG. 5 is a partly sectional, side view showing a known receptacle terminal.
Figure 6:
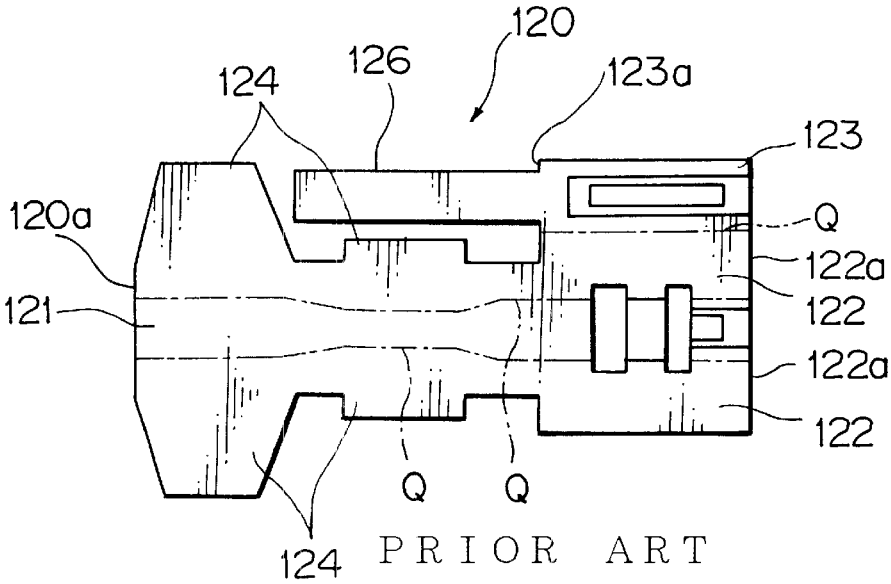
PRIOR ART F I G. 6
FIG. 6 is a plan view showing a blank defining the receptacle terminal of FIG. 5.

Referring to FIGS. 1 to 4, a terminal 1 of an embodiment according to the present invention will be discussed. As illustrated in FIGS. 1 to 3, the terminal 1 is used for electrically connecting an opposing terminal pin 2 (illustrated by chain lines of FIG. 2) to an electrical wire 3. The opposing terminal pin 2 is a connection terminal for an electrical element such as a tab of a busbar, a relay, and a fuse.

The opposing terminal pin 2, as illustrated in FIG. 2, has a pin 2*a* insertable into an electrical connection portion 5 described later of the terminal 1. The pin 2*a* has a shape like a blade. The opposing terminal pin 2 including the pin 2*a* is made of an electrically conductive material.

The terminal 1, as illustrated in FIGS. 1 and 2, has an electrical wire connection portion 4 for connecting the electrical wire 3 and has the electrical connection portion 5 for electrically connecting the pin 2*a* of the opposing terminal pin 2 thereto.

The electrical wire connection portion 4, as illustrated in FIGS. 1 and 2, has a bottom wall 10*a* and a plurality of crimping pieces 11 each contiguous with a side edge of the bottom wall 10*a*. The bottom wall 10*a* is flat and has a rectangular shape in a plan view. On the bottom wall 10*a*, there is disposed a stripped core end of the electrical wire 3. The bottom wall 10*a* is the base wall described in the summary of the invention. Each crimping piece 11 is contiguous to a lateral end of the bottom wall 10*a*.

The stripped core end disposed on the bottom wall 10*a* is pressed and crimped by the crimping pieces 11. Thus, the crimping pieces 11 electrically connect to the electrical wire 3.

The electrical connection portion 5, as best shown in FIG. 2, has a flat bottom wall 10*b*, a top wall 12 spaced from the bottom wall 10*b*, a pair of side walls 13 joining the bottom wall 110*b* to the top wall 112, and a resilient piece 15. The electrical connection portion 5, as illustrated in FIG. 3, is a hollow square cylinder having the walls 10*b*, 12, 13. The bottom wall 10*b* aligns with and is contiguous with the bottom wall 10*a* of the electrical wire connection portion 4.

The bottom wall 10*b* is rectangular in a plan view thereof. The bottom wall 10*b* has a width substantially equal to that of the bottom wall 10*a* of the electrical wire connection portion 4. The top wall 12 has a rectangular plan shape substantially the same as that of the bottom wall 10*b*. The top wall 12 is arranged to be parallel to the bottom wall 10*b*.

Each side wall 13 is contiguous with a side end of the bottom wall 10*b* and is also contiguous with a side end of the top wall 12. The side walls 13 are parallel with each other. Note that the bottom wall 10*b* and the top wall 12 correspond to the pair of walls described in the summary of the invention.

The cylindrical electrical connection portion 5 receives the pin 2*a* therein. That is, the pin 2*a* is inserted between the bottom wall 10*b* and the top wall 12 and between the pair of side walls 13. The pin 2*a* is inserted into and drawn out from the electrical connection portion 5 in a longitudinal direction parallel to the bottom wall 10*b* and the top wall 12.

The resilient piece 15 extends longitudinally in a direction substantially parallel to the insertion direction of the pin 2*a* along the bottom walls 10*a*, 10*b* and the top wall 12. The resilient piece 15 overlies on the bottom wall 10*b*.

The resilient piece 15 has one end 15*a* contiguous to the top wall 12 at a position near the electrical wire connection portion 4. The resilient piece 15 has another end 15*b* positioned near a longitudinal edge of the bottom wall 10*b* by turning back the resilient piece 15 from the one end of 15*a*.

The resilient piece 15 is a cantilever having the base end 15*a* contiguous with the top wall 12. The resilient piece 15 has a central portion 15*c* positioned between the ends 15*a*, 15*b* over the bottom wall 10*b*.

The resilient piece 15 has a resilient press-contact portion 16. The resilient press-contact portion 16 is defined in the end 15*b* side of the resilient piece 15. The resilient press-contact portion 16 extends from the central portion 15*c* toward the top wall 12. The resilient press-contact portion 16 is a longitudinal bump.

The resilient press-contact portion 16, which is defined in a free end of the resilient cantilevered resilient piece 15, is movable toward and apart from the top wall 12.

When the pin 2*a* is inserted into the electrical connection portion 5, the resilient press-contact portion 16 of the resilient piece 15 contacts the pin 2*a*. While the pin 2*a* is inserted into the electrical connection portion 5, the resilient press-contact portion 16 moves apart from the top wall 12. Thereby, the resilient piece 15 exerts a force on the pin 2*a* to urge it against the top wall 12. The resilient piece 15 and the top wall 12 pinch. the inserted pin 2*a* therebetween.

The terminal 1 also has an opening 17 receiving a folded piece 40. The folded piece 40 is defined by folding a joining piece 38 of a resilient piece part 26 of a blank 20 described later. The opening 17, as illustrated in FIG. 3, is defined across one of the side walls 13 and the top wall 12 so as to penetrate through them. The opening 17 receives the folded piece 40 when the terminal 1 is formed by bending the blank 20 along fold lines 30*a*, 30*b*, 31, 32 described later.

Figure 4:
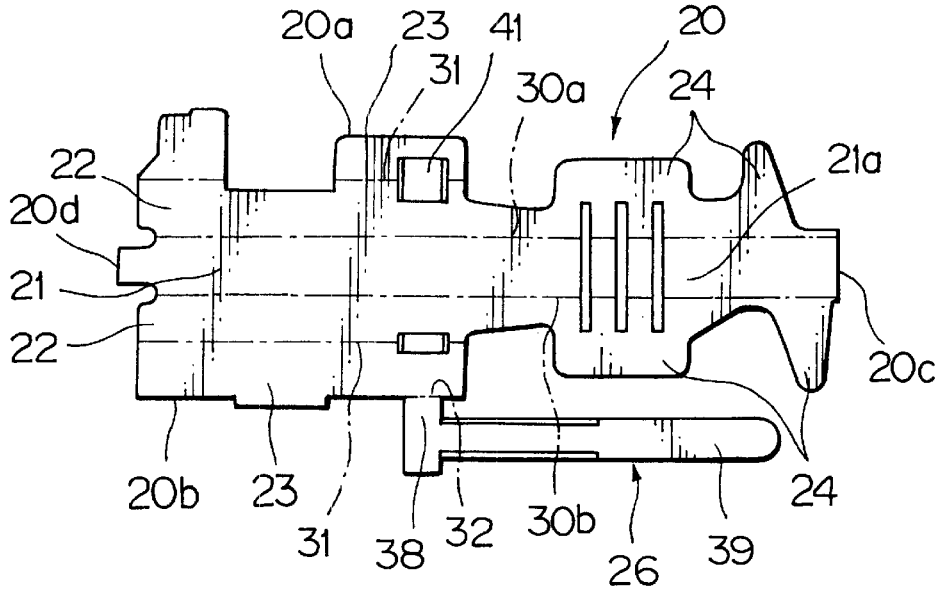
FIG. 4 is a plan view showing a blank for defining the receptacle terminal of the embodiment.

The terminal 1 is formed by bending the blank 20 shown in FIG. 4. The blank 20 is a thin plate having an electrical conductivity, which is obtained by striking out an electrically conductive metal sheet made of copper, a copper alloy (such as brass or beryllium-copper). The blank 20 has a rectangular shape in a plan view thereof.

The blank 20, as illustrated in FIG. 4, has a bottom wall part 21 positioned longitudinally in a middle portion thereof, a pair of side wall parts 22, a pair of top wall parts 23, a plurality of crimping piece parts 24, and a resilient piece part 26.

The bottom wall part 21 extends in a longitudinally direction of the blank 20. The bottom wall part 21 defines the bottom walls 10*a*, 10*b* of the terminal 1 by bending the blank 20 along fold lines 30*a*, 30*b*, 31, 32 as described later in detail.

Each side wall part 22 extends longitudinally and is contiguous with each side end of the bottom wall 10*b* of the bottom wall part 21. Each side wall part 22 corresponds to each side wall 13 of the terminal 1 defined by bending the blank 20 along the fold lines 30*a*, 30*b*, 31, 32.

Each top wall part 23 extends in a longitudinal direction of the blank 20 and is contiguous with a side end of each side wall part 22. Each top wall part 23 corresponds to the top wall 12 of the terminal 1 defined by bending the blank 20.

Each crimping piece part 24 is contiguous with a side end portion of a part 21*a* of the bottom wall part 21. The crimping piece part 24 corresponds to the crimping piece 11 of the terminal 1 defined by bending the blank 20.

The part 21*a* of the bottom wall part 21 corresponds to the bottom wall 10*a* on which the electrical wire 3 is disposed.

The resilient piece part 26 has the joining piece 38 and an extended strip 39. The joining piece 38 is contiguous to a longitudinally inner end portion of one of the top wall parts 23 near the crimping piece part 24 of the blank 20. The joining piece 38 projects outward from the top wall part 23 in a lateral direction of the blank 20. That is, the joining piece 38 projects outward from a lateral edge 20*b* of the blank 20.

The extended strip 39 has one end contiguous with the joining piece 38 and extends in a longitudinal direction of the blank 20, that is, in the insertion direction of the pin 2*a* toward a longitudinal edge 20*c* of the crimping piece side of the blank 20.

The blank 20 also has a folded-part receiving opening 41 corresponding to the opening 17. The receiving opening 41 penetrates through the blank 20. The receiving opening 41 is formed to cross a fold line between the other top wall part 23 and the side wall part 22 contiguous to the top wall part 23.

The receiving opening 41 has a substantially rectangular shape in a plan view of the blank. The receiving opening 41 receives the folded piece 40 defined by bending the joining piece 38 along the fold line 32.

To form the terminal 1 from the blank 20, first, the blank 20 is folded along a pair of fold lines 30*a*, 30*b* and a pair of fold lines 31, which are shown by chain lines of the drawing. Thereby, the side wall parts 22 are opposed to each other and the top wall part 23 is opposed to the bottom wall part 21.

The top wall parts 23 overlap one another. The inner top wall part 23 has the joining piece 38, and the outer top wall part 23 has the receiving opening 41.

The fold lines 30*a*, 30*b* each extending in a longitudinal direction of the blank 20 each are positioned between the bottom wall part 21 and one of the side wall parts 22. Each fold line 31 extending in longitudinal direction of the blank 20 is located at a middle position between one of the fold lines 30*a*, 30*b* and one of side edges 20*a*, 20*b* of the blank 20.

Furthermore, along a fold line 32 shown by a chain line of FIG. 4, the joining piece 38, that is, the resilient piece part 26 is bent to lie over the top wall part 23. The fold line 32 aligns with the edge 20*b* of the blank 20. The fold line 32 extends in a longitudinal direction of the blank 20.

The folded piece 40 (see FIG. 3) defined by bending the joining piece 38 along the fold line 32 is partially inserted into the receiving opening 41 to be received therein. Then, the extended strip 39 is bent such that the free end of the extended strip 39 is directed toward an edge 20*d* of the blank 20 which is positioned in the side of the side wall parts 22. The extended strip 39 is provided with the resilient press-contact portion 16. Accordingly, the terminal 1 of the embodiment is obtained.

Referring to operation of the thus configured terminal, the pin 2*a* is inserted into the electrical connection portion 5, so that a forward portion of the pin 2*a* contacts the resilient press-contact portion 16 of the resilient piece 15. With the insertion of the pin 2*a* into the electrical connection portion 5, the resilient piece 15 resiliently deflects so that the resilient press-contact portion 16 moves apart from the top wall 12 toward the bottom walls 10*a*, 10*b*.

The resilient piece 15 exerts a force urging the pin 2*a* against the top wall 12. The resilient piece 15 and the top wall 12 pinch the pin 2*a* therebetween.

In the embodiment, the resilient piece part 26 of the blank 20 has the joining piece 38 and the extended strip 39 contiguous with the joining piece 38. The joining piece 38 extends laterally outward from the side edge 20*b* of the top wall part 23. The extended strip 39 extends along the insertion direction of the pin 2*a*.

Thus, the extended strip 39 of the resilient piece part 26 does not interfere with the crimping piece part 24. The crimping piece part 24 may have a desirable size, allowing a sure connection of the electrical wire connection portion 4 to the electrical wire 3. The electrical wire 3 may have a comparatively larger thickness.

No interference of the resilient piece part 26 with the crimping piece part 24 allows a desirable width of the extended strip 39.

Furthermore, the folded piece 40 defined by bending the joining piece 38 along the edge 20*b* is partially inserted into the receiving opening 41. Thus, the extended strip 39 may have a width substantially equal to that of the top wall 12 or the bottom wall 10*a* or 10*b*.

Accordingly, the resilient piece 15 may exerts an enough resilient force on the pin 2*a* to urge it against the top wall 12, preventing an unintentional disengagement of the pin 2*a*.

The crimping piece part may have a desirable size, allowing a sure connection of the electrical wire connection portion 4 to the electrical wire 3. The electrical wire 3 may have a comparatively larger thickness. The resilient piece may exerts an enough resilient force on the pin to urge it against the top wall, preventing an unintentional disengagement of the pin.

Accordingly, the resilient piece may exerts an enough resilient force on the pin to urge it against the top wall, preventing an unintentional disengagement of the pin.

What is claimed is:

1. A receptacle terminal comprising:

an electrical wire connection portion electrically connected to an electrical wire, and an electrical connection portion receiving an opposing terminal pin, the electrical wire connection portion having a base wall retaining the electrical wire and a plurality of crimping pieces contiguous to the base wall for crimping the electrical wire, the electrical connection portion having a resilient piece and a pair of walls comprising a top wall and a portion of the base wall for receiving the pin, the resilient piece urging the pin against the top wall to pinch the pin therebetween, wherein the receptacle terminal is defined by bending a blank having parts corresponding to the base wall, the crimping piece, the pair of walls, and the resilient piece, and the said resilient piece corresponding part has a joining piece and an extended strip joined to the joining piece, the extended strip extending in an insertion direction of the pin, the joining piece projecting outward from a longitudinal edge of the part corresponding to the top wall, wherein the joining piece of the resilient piece corresponding part is bent along the edge of the top wall, and the blank has an opening receiving a folded part of the joining piece.

2. The receptacle terminal set forth in claim 1 wherein the joining piece is contiguous to the top wall, and the extended strip of the blank extends parallel to an insertion direction of the pin along the crimping piece corresponding part.

* * * * *